US006183343B1

(12) United States Patent
Buzzetti

(10) Patent No.: US 6,183,343 B1
(45) **Date of Patent: *Feb. 6, 2001**

(54) POLISHING APPARATUS WITH DEFINED PATTERN

(76) Inventor: Mike Buzzetti, 4401 "D" El Camino Real, Atascadero, CA (US) 93422

( * ) Notice: Under 35 U.S.C. 154(b), the term of this patent shall be extended for 0 days.

This patent is subject to a terminal disclaimer.

(21) Appl. No.: 09/390,860

(22) Filed: Sep. 3, 1999

Related U.S. Application Data

(63) Continuation of application No. 08/922,070, filed on Sep. 2, 1997, now Pat. No. 5,947,797.

(60) Provisional application No. 60/025,906, filed on Sep. 11, 1996.

(51) Int. Cl.[7] ..... B24B 51/00

(52) U.S. Cl. ..... 451/5; 451/11; 451/42; 451/160; 451/384

(58) Field of Search ..... 451/5, 11, 41, 451/42, 158, 159, 160, 278, 384, 389

(56) References Cited

U.S. PATENT DOCUMENTS

| | | | |
|---|---|---|---|
| 4,693,035 | | 9/1987 | Doyle . |
| 4,979,334 | | 12/1990 | Takahaski . |
| 5,107,627 | | 4/1992 | Mock, Jr. et al. . |
| 5,201,148 | | 4/1993 | Rupert et al. . |
| 5,216,846 | | 6/1993 | Takahaski . |
| 5,349,784 | | 9/1994 | Grois et al. . |
| 5,454,747 | * | 10/1995 | Ascalon ..... 451/389 X |
| 5,458,531 | | 10/1995 | Matsuoka et al. . |
| 5,480,344 | * | 1/1996 | Xu et al. ..... 451/42 X |
| 5,516,328 | | 5/1996 | Kawada . |
| 5,558,564 | * | 9/1996 | Ascalon ..... 451/389 X |
| 5,674,114 | | 10/1997 | Miller et al. . |
| 5,743,787 | | 4/1998 | Ishiyama et al. . |

* cited by examiner

*Primary Examiner*—Timothy V. Eley
(74) *Attorney, Agent, or Firm*—Leo F. Costello

(57) ABSTRACT

An apparatus for creating and maintaining a substantially perfect figure eight polishing pattern for polishing fiber optic connectors and similarly configured industrial components. The apparatus is capable of simultaneously performing this figure eight polishing pattern on the multiplicity of such connectors and components. Moreover, the specific embodiment disclosed includes a computer program that controls the apparatus. By simultaneously polishing a minimum of forty-eight fiber optic connectors, or similarly configured industrial components, with a polish being better than any now capable of being obtained by the prior art, this invention enables the output of polished fiber optic connectors and similarly configured industrial components to be increased three to four fold over currently employed polishing apparatus while significantly reducing the cost of such polishing.

20 Claims, 2 Drawing Sheets

POLISHING APPARATUS WITH DEFINED PATTERN

CROSS REFERENCE TO RELATED APPLICATION

This application is a continuation of my prior copending application Ser. No. 08/922,070, filed Sep. 2, 1997 and entitled Computer-Controlled Method and Apparatus for Polishing, now U.S. Pat. No. 5,947,797 which in turn was based upon my Provisional Application No. 60/025,906, filed on Sep. 11, 1996.

FIELD

The present invention pertains to a polishing apparatus and more particularly to an apparatus for controlling the movement of a polishing member along a predetermined path.

BACKGROUND

Fiber optic connectors are required in large quantities in the telecommunications and cable TV markets for the manufacture of fiber optic cable assemblies and components. Current fiber optic connector polishers (a) polish only in a circular pattern which does not polish the face ends of fiber optic connectors as effectively as does a figure eight polishing, and (b) these current polishers can polish no more than eighteen connectors at one time.

The existing state of the art for fiber optic connector polishers is derived from modifications of gemstone polishing machines. These machines consisted of a rotating platter against which the gemstone was moved for polishing. This technique was adopted by the first fiber optic connector polishers, and then modified to their current state, by having a jig, holding no more than eighteen connectors, move, in small circles on the rotating platter, while endeavoring, unsuccessfully, to simulate a constant, figure eight polishing pattern. The figure eight polishing pattern, if it can be perfectly attained and maintained during the polishing operation, provides the optimum method of polishing the end faces of fiber optic connectors in that perfect figure eight pattern produces the most consistent radii and best polish obtainable on these connectors and similarly configured industrial components.

SUMMARY

An polishing apparatus is provided for creating and maintaining a substantially perfect figure eight polishing pattern for polishing fiber optic connectors and similarly configured industrial components. Further, the apparatus is capable of simultaneously performing this figure eight polishing pattern on a multiplicity of such connectors and components. Moreover, the specific embodiment disclosed includes a computer program that controls the apparatus. By simultaneously polishing a minimum of forty-eight fiber optic connectors, or similarly configured industrial components, with the polish being better than any now capable of being obtained in the prior art, this invention enables the output of polished fiber optic connectors and similar industrial components to be increased three to fourfold over currently employed polishing machines, while reducing significantly the cost of such polishing.

An object of this invention is to provide an apparatus for creating and maintaining a figure eight polishing pattern for polishing fiber optic connectors and similarly configured industrial components.

Another object is to provide such an apparatus that is capable of polishing in a substantially perfect figure eight pattern.

A further object is to provide an apparatus for creating a substantially uniformly constant, substantially perfect, figure eight polishing pattern which will produce the optimum quality polishing of a multiplicity of fiber optic connectors or similarly configured industrial components.

An additional object is to provide an apparatus for creating a substantially perfect figure eight polishing pattern that is computer controlled.

A still further object is to incorporate a figure eight polishing apparatus into a compact polishing machine capable of creating and constantly maintaining a substantially perfect figure eight polishing pattern while simultaneously polishing, with optimum quality, at least forty-eight fiber optic connectors or similarly configured industrial components.

Yet another object is to provide such a polishing apparatus that has a layout which enables more than forty-eight such connectors or components to be subsequently added for simultaneous figure eight polishing.

DETAILED DESCRIPTION

Figure 1:
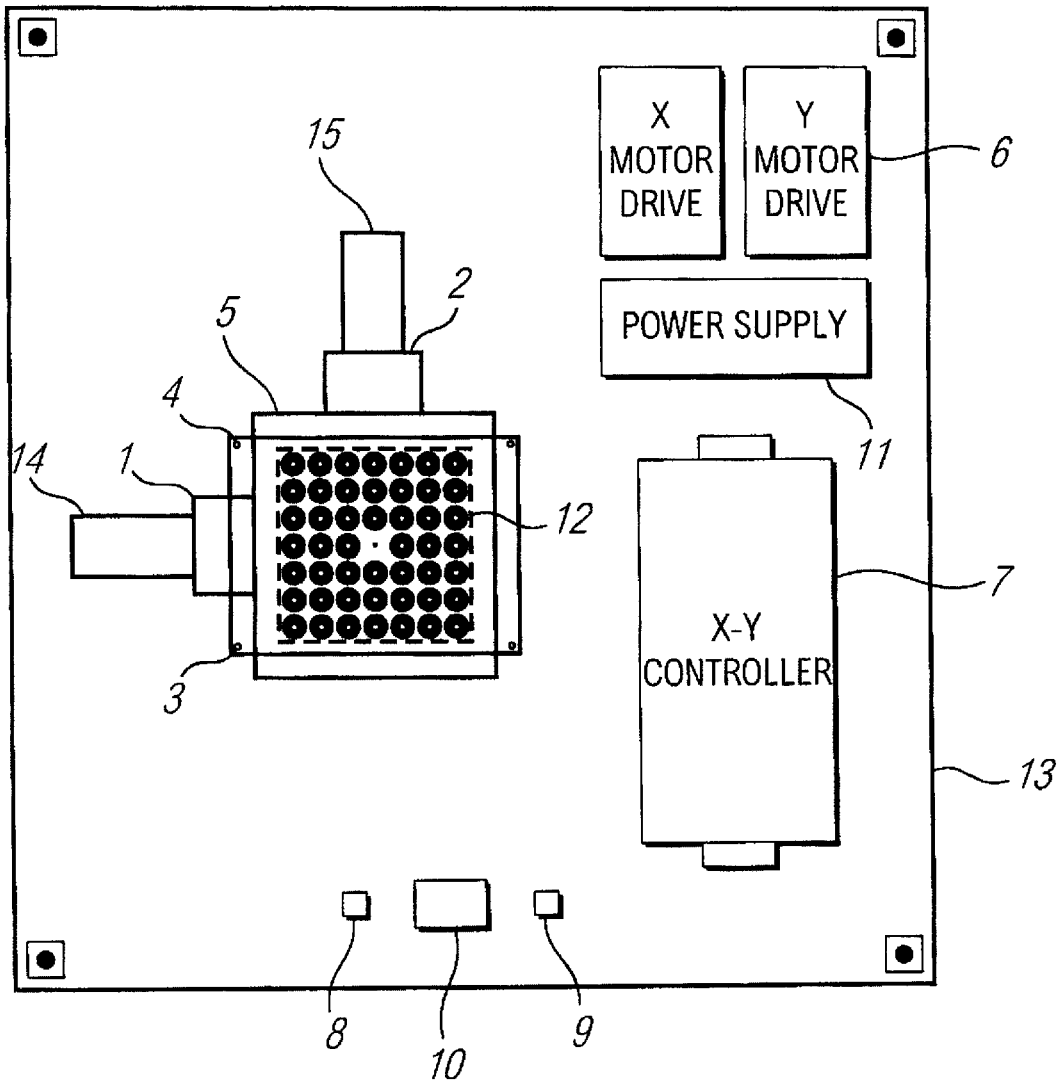
FIG. 1 is a schematic top view of the polishing apparatus of the present invention.
Figure 2:
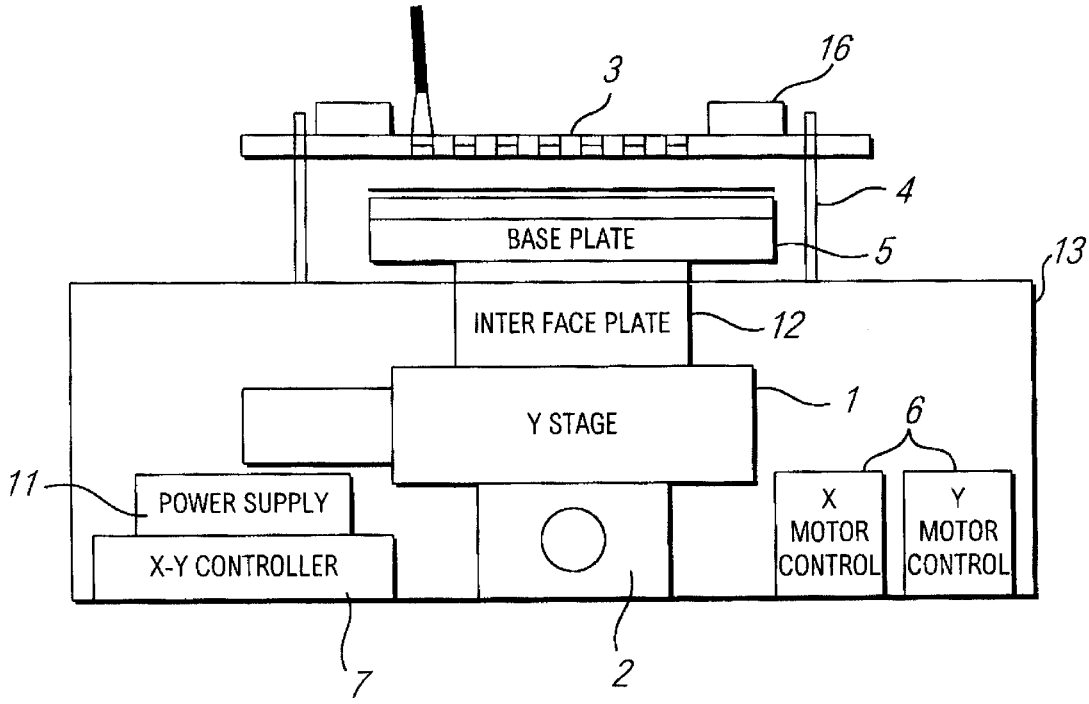
FIG. 2 is a schematic side elevation of the polishing apparatus and also shows a jig for mounting a component to be polished.
Figure 3:
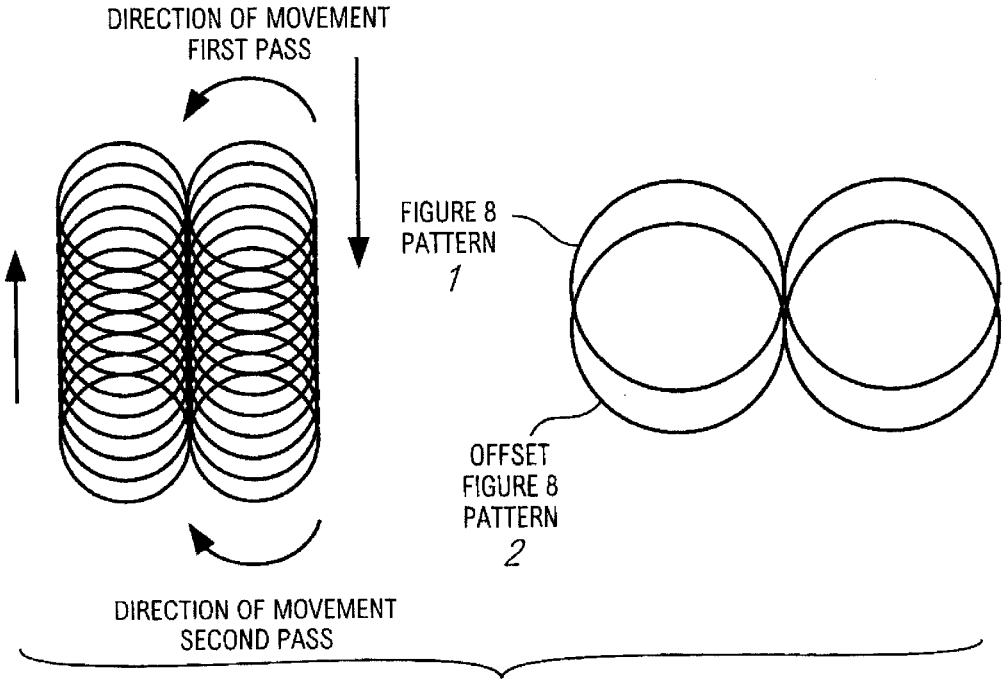
FIG. 3 are a schematic diagrams showing the path and direction of movement of the base plate as controlled by the subject polishing apparatus.

As illustrated by FIGS. 1 and 2, the layout of the polishing apparatus allows the use of all the space on the polishing surface. By using a rectangular array the connectors are spaced at 1" intervals and create an array which can be expanded to as many as two hundred connectors to be polished simultaneously. Polishing machines now in use do not allow for this type of expansion in that they can only place the connectors in the outermost edges of the polishing plate. As illustrated by FIG. 3, the polishing apparatus can accurately produce a constant and perfect figure eight polishing pattern and move this pattern in any direction by using the invention's computer controlled x-y motion control process with circular interpolation.

The polisher (FIGS. 1 and 2) includes a casing 13. Installed within the casing is an x-stage 1, a y-stage 2, an interface plate 12, a base plate 5, motor drives 6, a power supply 11, an x-y controller 7, an x-motor 15, and a y-motor 14. The mechanical components for the motion system comprise the x-stage 2 mounted to the casing 13, the y-stage 1 mounted to the x-stage 2, the interface plate 12 mounted to the y-stage 1, and the base plate 5 mounted to the interface plate 12.

The x-stage 2 and the y-stage 1 are moved via the motors 15 and 14, respectively, attached to these stages. The y-motor 14 attached to the y-stage 1 moves this stage in the y-axis by a ball screw mechanism built into the stage. The x-motor 15 attached to the x-stage 2 moves the x-stage 2 in the x-axis. The y-stage 1 and the x-stage 2 are controlled by an x-y controller 7 and motor drives 6 which are powered by a power supply 11. The controller 7 is a computer-controlled motion system which can be programmed for all types of movement.

The interface plate 12 (FIGS. 1 and 2) is attached to the y-stage 1 as a receiving mechanism for the base plate 5 to which is attached the polishing surface for operation of the polisher apparatus. Different polishing surfaces can be attached to the base plate 5 for the polishing process. These surfaces include such polishing mediums as diamond, aluminum oxide, and silicon carbide polishing papers and other coated plates and pads. The polishing plate 3 is set on the fixed locating members 4 so that the exposed surface of the component to be polished is touching the polishing surface which is applied to the base plate 5. Weights 16 are then applied to the top surface of the polishing plate 3 to supply the correct amount of pressure to the component to be polished. The pressure may also be applied via a pneumatic pressure control system.

The apparatus (FIGS. 1 and 2) is controlled by a timer 10, a start switch 9 and a stop switch 8. The amount of time to polish is set on the timer. The process is started by pressing the start switch 9. The polishing process can be stopped at any time by pressing the stop switch 8.

In the disclosed embodiment, the figure eight pattern a (FIG. 3) is created by computer programming the x-y motion process to move in a clockwise circle starting from the center of the figure eight, then moving in a counter clockwise circle to finish the figure eight pattern. The offset figure eight patterns b are created by moving the figure eight pattern a along a path D in one direction and in small increments (approximately 0.50 inch each). The figure eight pattern is thus repeated several times along a specified distance of the path D. Upon completion of the movement along path D, the movement is reversed so as to move the figure eight pattern along path U a specified distance in the opposite direction. The whole process is repeated as many times as needed to perform the desired amount of time set by the timer (see 10, FIG. 1). By combining these patterns the process creates a continuous figure eight movement which enables the polishing surface of the polishing apparatus to provide the optimum quality polishing, simultaneously, of not less than forty-eight fiber optic connectors or similarly configured industrial components.

The computer program for the figure eight pattern is as follows:

```
DEL R: required to overwrite existing program R
DEF R
PSCLD 15
PSCLA2
PSCLAV2
PAD1.3000
PA1.5000
COMEXL.11
DRFLVL11
L30
PARCOP0,0,-6000,0
PARCOMO,0,6000,0
PLINO,-400
LN
pad0.6
PARCOP0,0,-6000,0
PARCOM0,06000,0
END
DEL F: required to overwrite existing program F
DEF F
PSCLD15
PSCLA2
PAD1.3000
PAI.5000
PVI.5000
DRFLVL11
COMEXL11
L30
PARCOP0,06000,0
PARCOM0,0-6000,0
PLIN0,400
LN
pad0.6
PARCOP0,6000,0
PARCOM0,0,-6000, 0
END
DEL Q: required to overwrite existing program Q
DEF Q
ZERO
PRUNF
PRUNR
prunf
prunr
prunf
prunr
END
DEL ZERO: required to overwrite existing program ZERO
DEF ZERO
comex11,1
A1.0000,1.0000
V1.0000,1.0000
AD.3000,.3000
D50000,50000
GO
D-15000,-26000
GO
END
del setup
def setup
comexs2
COMEXL11
DRFLVL11
INFEN1
INLVL11111111111111111111111111111111
INFNC1-D
INFNC2-4p
INFNC3-p
INSELP2,50
startp setup
end
DEL START: required to overwrite existing program
  START
DEF START
Q
END
PCOMP R
PCOMP F
PCOMP START
PCOMP SETUP
```

Although a preferred embodiment of the present invention has been shown and described, various modifications and substitutions may be made thereto without departing from the spirit and scope of the present invention. Accordingly, it is to be understood that the present invention has been described by way of illustration and not limitation

What is claimed is:

1. A polishing apparatus comprising:

a first stage including a first mounting member and a first staging member supported on the first mounting member for movement along a first path, a second stage including a second mounting member supported on the first staging member and a second staging member supported on the second mounting member for movement along a second path in angular relation to the first path, a polishing member mounted on the second staging member, and a drive mechanism operable to simultaneously move the first and second staging members along their respective paths so that the polishing member traces a predetermined pattern.

2. The apparatus of claim 1, wherein the paths of movement of the first and second staging members are rectilinear.

3. The apparatus of claim 1, wherein the first path is an x-axis, and wherein the second path is a y-axis substantially perpendicular to the x-axis.

4. The apparatus of claim 3, wherein the speed of movement of the one staging member is a multiple of the speed of movement of the other staging member.

5. The apparatus of claim 4, wherein the multiple is 2.

6. The apparatus of claim 1, wherein the pattern is a figure eight.

7. The apparatus of claim 1, wherein the first mounting member is mounted for movement along a third path.

8. The apparatus of claim 1, wherein the movement along said paths is reciprocal.

9. The apparatus of claim 1, wherein the drive mechanism includes motors connected to the first and second staging members.

10. The apparatus of claim 1, wherein the drive mechanism is computer-controlled.

11. A polishing apparatus comprising:

a support, a first stage including a first track mounted on the support and a first staging member supported on the track for movement along an x-axis, a second stage including a second track mounted on the first staging member and a second staging member mounted on the second track for movement along a y-axis perpendicular to the x-axis, a polishing member mounted on the second staging member, and a drive mechanism connected to the first and second staging members for moving the staging members along their respective axes so that the polishing member traces a closed arcuate pattern.

12. The apparatus of claim 11, wherein the stroke of one of the members is a multiple of the stroke of the second member.

13. The apparatus of claim 12, wherein the multiple is 2.

14. The apparatus of claim 11, wherein the pattern is a figure eight.

15. The apparatus of claim 11, wherein the first track is mounted on the support for movement along a third axis substantially parallel to one of the x- and y-axes.

16. The apparatus of claim 11, wherein the drive mechanism includes x and y motors connected to each stage, computer controlled x and y motor drives respectively connected to the motors, and a programmable x-y controller connected to the x-y motor drives.

17. The apparatus of claim 11, wherein the movement of the first and second staging member is reciprocal and rectilinear.

18. A polishing apparatus comprising:

a support, a first stage including a first rectilinear track mounted on the support and a first staging member supported on the track for reciprocal movement along an x-axis, a second stage including a second rectilinear track mounted on the first staging member and a second staging member mounted on the second track reciprocal movement along a y-axis perpendicular to the x-axis, a polishing member mounted on the second staging member, and a drive mechanism including x and y motors having a driving connection to the first and second stages respectively, x and y motor drives respectively connected to the x and y motors, and a programmable x-y controller connected to the x-y motor drives for moving the staging members along their respective axes with the stroke of one of the members being a multiple of the stroke of the second member so that the polishing member traces a closed arcuate pattern.

19. The apparatus of claim 18, wherein the multiple is 2.

20. The apparatus of claim 19, wherein the pattern is a figure eight.

* * * * *